US007676331B2

(12) United States Patent
Sawada et al.

(10) Patent No.: US 7,676,331 B2
(45) Date of Patent: Mar. 9, 2010

(54) TORQUE ESTIMATING DEVICE OF COMPRESSOR

(75) Inventors: Yoshikatsu Sawada, Kariya (JP); Yasutane Hijikata, Nagoya (JP); Kazuma Miyazaki, Toyota (JP)

(73) Assignees: DENSO CORPORATION, Kariya (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 12/153,280

(22) Filed: May 15, 2008

(65) Prior Publication Data

US 2008/0288185 A1 Nov. 20, 2008

(30) Foreign Application Priority Data

May 16, 2007 (JP) ..... 2007-130223

(51) Int. Cl.
*G01L 3/00* (2006.01)

(52) U.S. Cl. ..... 702/41; 702/47; 702/50; 62/228.1; 62/228.3

(58) Field of Classification Search ..... 702/41, 702/33, 47, 98, 50; 62/228.1, 323.4, 228.3
See application file for complete search history.

(56) References Cited

U.S. PATENT DOCUMENTS

2004/0211204 A1* 10/2004 Matsubara et al. ..... 62/228.1

FOREIGN PATENT DOCUMENTS

JP A-2006-272982 10/2006

OTHER PUBLICATIONS

U.S. Appl. No. 12/153,574, filed May 21, 2008, Sawada et al.

* cited by examiner

*Primary Examiner*—Drew A Dunn
*Assistant Examiner*—Hien X Vo
(74) *Attorney, Agent, or Firm*—Posz Law Group, PLC

(57) ABSTRACT

A compressor drive torque estimating device suppresses a discrepancy between an estimated drive torque, which is based on a torque estimating device of a compressor, and an actual drive torque of the compressor. The discrepancy is due to delay in switching between employment of the torque estimating device and the actual drive torque of the compressor in judging the compressor torque. Thus, even in a transitional state immediately after the start of compression, the idling speed of an engine driving the compressor is controlled based on an accurate estimate of the compressor torque, to improve the stability of the engine idle speed.

6 Claims, 4 Drawing Sheets

TORQUE ESTIMATING DEVICE OF COMPRESSOR

BACKGROUND OF THE INVENTION

1. Field of the Invention

The present invention relates to a torque estimating device for estimating the drive torque of a compressor.

2. Description of the Related Art

Since the past, the compressor for a vehicular use air-conditioning system has obtained its drive force from the vehicle engine. In this type of vehicle, in general, the drive torque of the compressor is estimated and the estimated drive torque is used to control the engine output so as to prevent fluctuation of the engine speed even if the drive torque of the compressor changes. For this reason, suitable estimation of the torque of the compressor is an important task.

From this background, it is known to successively switch the torque estimating means after startup of the compressor so that a startup stage torque estimating means estimates the torque of the compressor in the initial period after startup of the compressor and a stable stage torque estimating means estimates the torque of the compressor in the steady state and thereby enable suitable estimation of the torque in accordance with the stage after compressor startup (for example, see Japanese Patent Publication (A) No. 2006-272982).

Japanese Patent Publication (A) No. 2006-272982 utilizes the property that the high pressure side pressure of the refrigeration cycle rises and peaks somewhat delayed from the actual rise of the torque of the compressor at the time of startup to deem that the startup of the compressor has been completed when the rise of the high pressure side pressure becomes 0 or less and switches the torque estimating means of the compressor accordingly. However, since the timing of switching the torque estimating means of the compressor is not based on the actually measured value, the precision of estimation deteriorates due to the delay of the switching timing.

SUMMARY OF THE INVENTION

The present invention, in consideration of the above point, has as its object to suppress discrepancy between the estimated drive torque and the actual drive torque of a compressor due to the delay of the switching timing of the torque estimating means of the compressor.

To achieve this object, in the present invention, there is provided a compressor drive torque estimating device able to be utilized for a system provided with a refrigeration cycle (1) in which a refrigerant is circulated by a compressor (2) driven by a drive source carried in a vehicle, provided with a flow rate detecting means (34) for detecting a flow rate of a refrigerant circulated through the refrigeration cycle (1), a check valve (35) provided at a discharge pressure region (27) of the compressor (2) and opening only in a refrigerant discharge direction of the compressor (2), a storage part storing an estimated drive torque characteristic setting a correlation between a drive torque behavior of the compressor (2) and an elapsed time from the start of operation of the compressor, a first estimated drive torque calculating means (S44) for calculating a first estimated drive torque (TrkA) of the compressor (2) based on the estimated torque characteristic stored in the storage part, a second estimated drive torque calculating means (S45) for calculating a second estimated drive torque (TrkB) of the compressor (2) based on a flow rate of the refrigerant detected by the flow rate detecting means (34), and an estimated drive torque switching means (S46 to S50) for switching an estimated drive torque (STrk) of the compressor (2) from the first estimated drive torque (TrkA) to the second estimated drive torque (TrkB), the estimated drive torque switching means (S46 to S50) switching an estimated drive torque (STrk) of the compressor (2) from the first estimated drive torque (TrkA) to the second estimated drive torque (TrkB) based on a physical quantity corresponding to a valve opening pressure of the check valve (35).

According to this, the estimated drive torque switching means (S46 to S50) switches between a first estimated drive torque (TrkA) calculated by the first estimated drive torque calculating means (S44) and a second estimated drive torque (TrkB) calculated by the second estimated drive torque calculating means (S45) based on a physical quantity corresponding to the valve opening pressure of the check valve (35), so it is possible to calculate the estimated drive torque (STrk) without delay of the switching timing. As a result, it is possible to calculate an estimated drive torque (STrk) of a high precision suppressed in discrepancy from the actual drive torque of the compressor in the transitional state right after start of compression by the compressor (2).

Further, the second estimated drive torque calculating means (S45) can calculate the second estimated drive torque (TrkB) based on the actually measured value of the flow rate of the refrigerant detected by the flow rate detecting means (34), so it is possible to calculate an estimated value of a high precision suppressed in discrepancy from the actual drive torque of the compressor (2) in the transitional state right after the start of compression by the compressor (2).

Further, the physical quantity corresponding to the valve opening pressure of the check valve (35) is the second estimated drive torque (TrkB) calculated by the second estimated drive torque calculating means (S45). The estimated drive torque switching means (S46 to S50) switches the estimated drive torque (STrk) of the compressor (2) from the first estimated drive torque (TrkA) to the second estimated drive torque (TrkB) when the second estimated drive torque (TrkB) becomes larger than a predetermined torque so can judge if the compressor (2) has finished starting up by the flow rate of the refrigerant detected by the flow rate detecting means (34), therefore can calculate an estimated value of a high precision suppressed in discrepancy from the actual drive torque of the compressor (2) in the transitional state right after the start of compression by the compressor (2).

Further, if the predetermined torque is increased in accordance with an increase in the pressure of the compressor discharge side, the check valve (35) increases in valve opening pressure in accordance with an increase in the pressure at the compressor discharge, so it is possible to calculate an estimated value of a high precision suppressed in discrepancy from the actual drive torque of the compressor in the transitional state right after the start of compression by the compressor (2). Note that the notations in parentheses in the above means show the correspondence with the specific means described in the later explained embodiments.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Below, an embodiment of the present invention will be explained based on FIG. 1 to FIG. 4. The present embodiment is an application of the present invention to a vehicular use idling speed control device. The vehicle of the present embodiment uses as the refrigerant compressor of the vehicular use air-conditioning system a compressor 2 able to obtain its drive force from an engine 11 driving a vehicle. The idling speed control device is designed to control the engine speed based on the estimated drive torque STrk of a later explained compressor 2.

Figure 1:
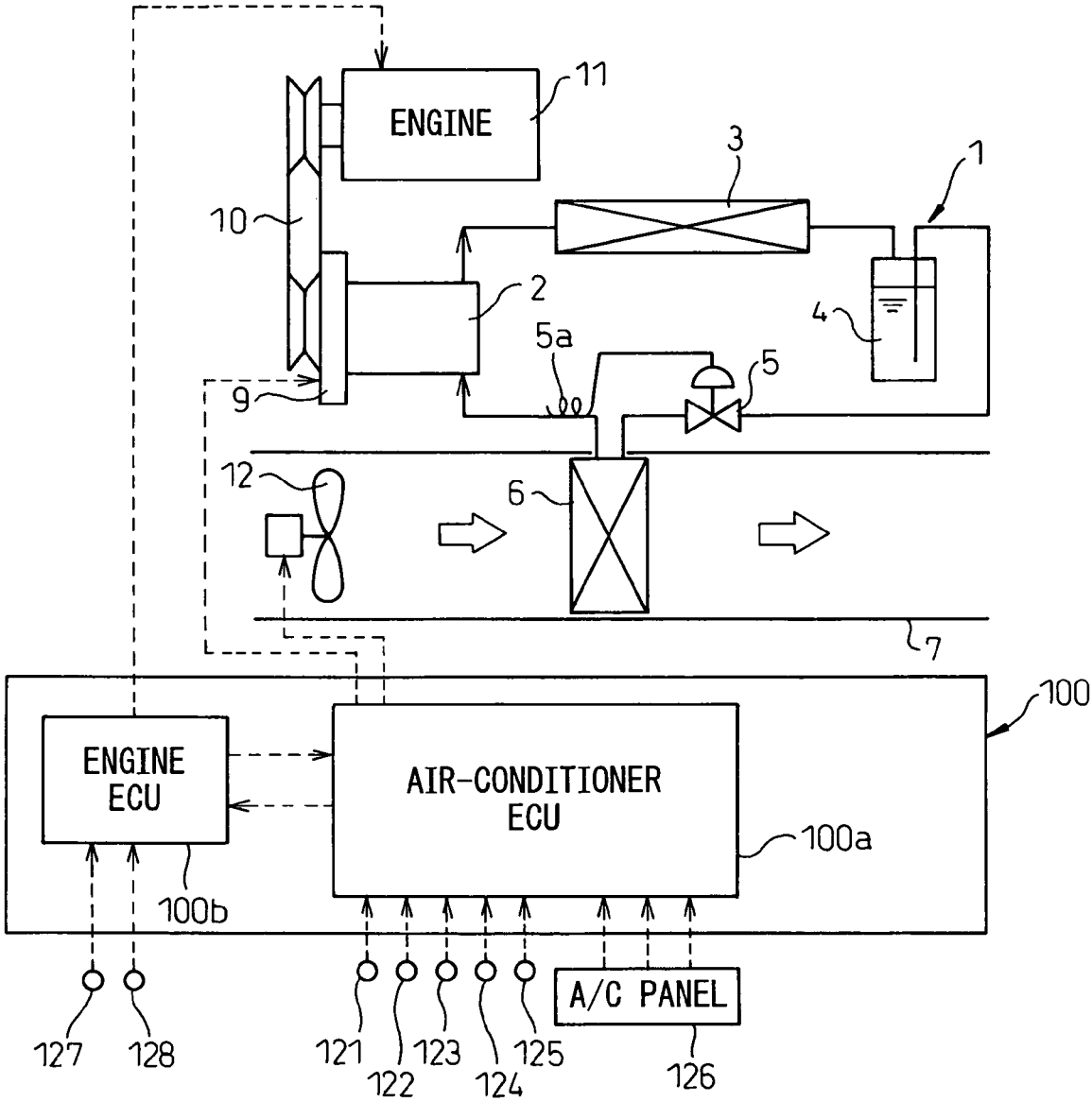
FIG. 1 is a view of the overall configuration of an idling speed control device according to an embodiment of the present invention.

First, FIG. 1 is a view showing the overall configuration of the present embodiment. The engine 11 has an intake pipe (not shown). Inside the intake pipe, a throttle valve (not shown) is arranged. The throttle valve adjusts the amount of air taken into the intake pipe in accordance with the opening degree accompanying depression of the accelerator pedal of a vehicle. Further, as is well known, in the engine 11, the engine speed (output) is adjusted by the intake air amount and fuel injection amount.

The intake pipe is provided with a bypass line (not shown). The bypass line has an idling adjustment valve (not shown) arranged in it. The idling adjustment valve changes the bypassed amount of the flow of intake air from upstream to downstream of the throttle valve in accordance with the valve opening degree. The idling speed of the engine is adjusted by the bypassed amount of this flow of intake air.

Further, the idling adjustment valve is configured by a known linear solenoid valve. It is electrically controlled by a drive voltage Visc output from a later explained engine control part 100*b* (engine ECU) and is designed to be changed in valve opening degree.

Next, the refrigeration cycle, forming part of a vehicular use air-conditioning system, is arranged in an engine compartment and has a compressor 2. Here, the refrigerant of the refrigeration cycle (1) in the present invention used is R134a. Note that the refrigerant of the refrigeration cycle (1) is not limited to R134a. $CO_2$ etc. may also be used.

The compressor 2 sucks in, compresses, and discharges the refrigerant at the downstream side of the later explained evaporator 6 in the refrigeration cycle 1. It is driven to operate by transmission of drive force through an electromagnetic clutch 9 and belt mechanism 10 from the engine 11. The general configuration of the compressor 2 will be explained later.

The compressor 2 is connected at its discharge side to a condenser 3 at its inlet side. This condenser 3 is arranged in the engine compartment between the engine 11 and a vehicle front grille (not shown). It is a radiator exchanging heat between the refrigerant discharged from the compressor 2 and the outside air blown by a blower fan (not shown) so as to cool the refrigerant.

The condenser 3 is connected at its outlet side to an gas-liquid separator 4 at its inlet side. The gas-liquid separator 4 separates the refrigerant cooled by the condenser 3 into a gas phase refrigerant and a liquid phase refrigerant.

The gas-liquid separator 4 is connected at its liquid phase refrigerant outlet side to an expansion valve 5. The expansion valve 5 reduces in pressure and causes expansion of the liquid phase refrigerant separated by the gas-liquid separator 4 and adjusts the flow rate of the refrigerant flowing out from outlet side of the expansion valve 5. Specifically, the expansion valve 5 has a feeler bulb 5*a* detecting the temperature of the refrigerant between the compressor 2 and the later explained evaporator 6. It detects the degree of overheating of the refrigerant at the suction side of the compressor based on the temperature and pressure of the refrigerant sucked into the compressor 2 and adjusts the valve opening degree so that this degree of overheating becomes a preset predetermined value.

The expansion valve 5 is connected at its downstream side to an evaporator 6. The evaporator 6 is arranged inside the air-conditioner case 7 of the air-conditioning unit. It is a heat exchanger exchanging heat between the refrigerant reduced in pressure and expanded by the expansion valve 5 and the air blown by a blower fan 12 arranged inside the air-conditioner case 7.

Here, the air of the cabin (inside air) or the air outside the cabin (outside air) sucked from the known inside/outside air switching box (not shown) provided at the air-conditioner case 7 is blown by the blower 12 through the inside of the air-conditioner case 7 toward the cabin. This blown air passes through the evaporator 6, then passes through a heater unit (not shown) and is blown out from vents into the cabin.

Further, inside the air-conditioner case 7 at a location right after the discharge of air from the evaporator 6, an evaporator temperature sensor 124 comprised of a thermistor detecting the discharge air temperature right after passing through the evaporator 6 is provided. The evaporator temperature sensor 124 will be later explained. Further, at the downstream end of air in the air-conditioner case 7, face vents for discharging air to the upper torsos of not shown cabin passengers, foot vents for discharging air to the feet of the cabin passengers, and defroster vents for discharging air to the inside surface of the front glass are formed. A discharge mode door (not shown) is provided for switching and opening/closing these vents.

The evaporator 6 is connected at its downstream side to the compressor 2 at a later explained suction port 21. After evaporation, the refrigerant again flows into the compressor 2. In this way, in the refrigeration cycle 1, a refrigerant is circulated in the order of the compressor 2→condenser 3→gas-liquid separator 4→expansion valve 5→evaporator 6→compressor 2.

Next, the electrical control part 100 of the present embodiment will be explained in brief. The electrical control part 100 is provided with an air-conditioner control part 100*a* (air-conditioner ECU) and an engine control part 100*b* (engine ECU). These are configured from a known microcomputer including a CPU, ROM, RAM, etc. and its peripheral circuits.

There, the air-conditioner control part 100*a* controls the vehicular air-conditioning system as a whole based on sensor detection signals of the group of air-conditioning sensors 121 to 125 and operation signals from the various types of air-conditioner operation switches SW provided at an air-conditioning control panel 126 arranged near the instrument panel in the front of the cabin. Further, the air-conditioner control part 100*a* stores a control program of the air-conditioning control device 9 etc. in the ROM of the microcomputer and performs various types of processing based on the control program.

As the group of air-conditioning sensors, specifically an outside air sensor 121 for detecting the outside air temperature Tam, an inside air sensor 122 for detecting the inside air temperature Tr, a sunlight sensor 123 for detecting the amount of sunlight Ts entering the cabin, an evaporator temperature sensor 124 arranged at the air discharge part of the evaporator 6 and detecting the evaporator discharge air temperature Te, a high pressure side pressure sensor 125 for detecting the pressure Pd of the refrigerant discharged from the compressor 2, etc. are provided.

Note that, in the present embodiment, the high pressure side pressure sensor 125 becomes the discharge side detecting means for detecting the physical quantity relating to the discharge refrigerant pressure Pd of the compressor 2 and the discharge refrigerant pressure Pd becomes the discharge side detection value. Further, in general, this high pressure side pressure sensor 125 is provided for detecting pressure abnormalities in the refrigeration cycle 1, so there is no need to newly provide a dedicated detecting means for detecting the physical quantity relating to the discharge refrigerant pressure Pd.

Furthermore, in the present embodiment, the evaporator temperature sensor 124 becomes the suction side pressure detecting means for detecting the physical quantity relating to the suction refrigerant pressure Ps of the compressor 2, and the evaporator discharge air temperature Te becomes the suction side pressure detection value. The evaporator discharge air temperature Te becomes substantially equal to the refrigerant evaporation temperature in the evaporator 6, so it is possible to use this refrigerant evaporation temperature to determine the refrigerant evaporation pressure in the evaporator 6 (that is, the suction refrigerant pressure Ps of the compressor 2).

As the various types of air-conditioner operation switches SW provided at the air-conditioning control panel 126, an air-conditioner switch for issuing a signal instructing operation of the compressor 2, a discharge mode switch for setting the discharge mode, an auto switch for issuing a signal instructing the automatic control state of the air-conditioning, a temperature setting switch for a temperature setting means for setting the cabin temperature, etc. are provided.

Next, the microcomputer of the air-conditioner control part 100*a* is connected at its output side through peripheral circuits, that is, drive circuits (not shown) for driving the various types of actuators, to the electromagnetic clutch 9, the blower fan 12 of the evaporator 6, etc. Further, the operations of these various types of actuators 9, 12 are controlled by an output signal of the air-conditioner control part 100*a*.

Further, the air-conditioner control part 100*a* is connected to the vehicle side engine control part 100*b*. These two control parts 100*a*, 100*b* are designed to be able to input and output signals with each other.

The engine control part 100*b*, as is well known, controls the amount of fuel injection into the vehicle engine 11, the ignition timing, etc. to optimum values based on the sensor detection signals from the group of engine sensors 127, 128 detecting the operating state of the vehicle engine 11 etc. and a control map of the later explained compressor estimated drive torque STrk. The engine control part 100*b* stores a control program of the estimated drive torque STrk and idling adjustment valve etc. in the ROM of the microcomputer and performs various types of processing based on the control program.

As the group of engine sensors, specifically, an engine speed sensor 127 for detecting the engine speed Ne, a throttle sensor 128 for detecting an opening degree of a throttle valve adjusting the amount of air sucked into the intake pipe in accordance with the depression of the accelerator pedal of the vehicle, etc. are provided.

Figure 2:
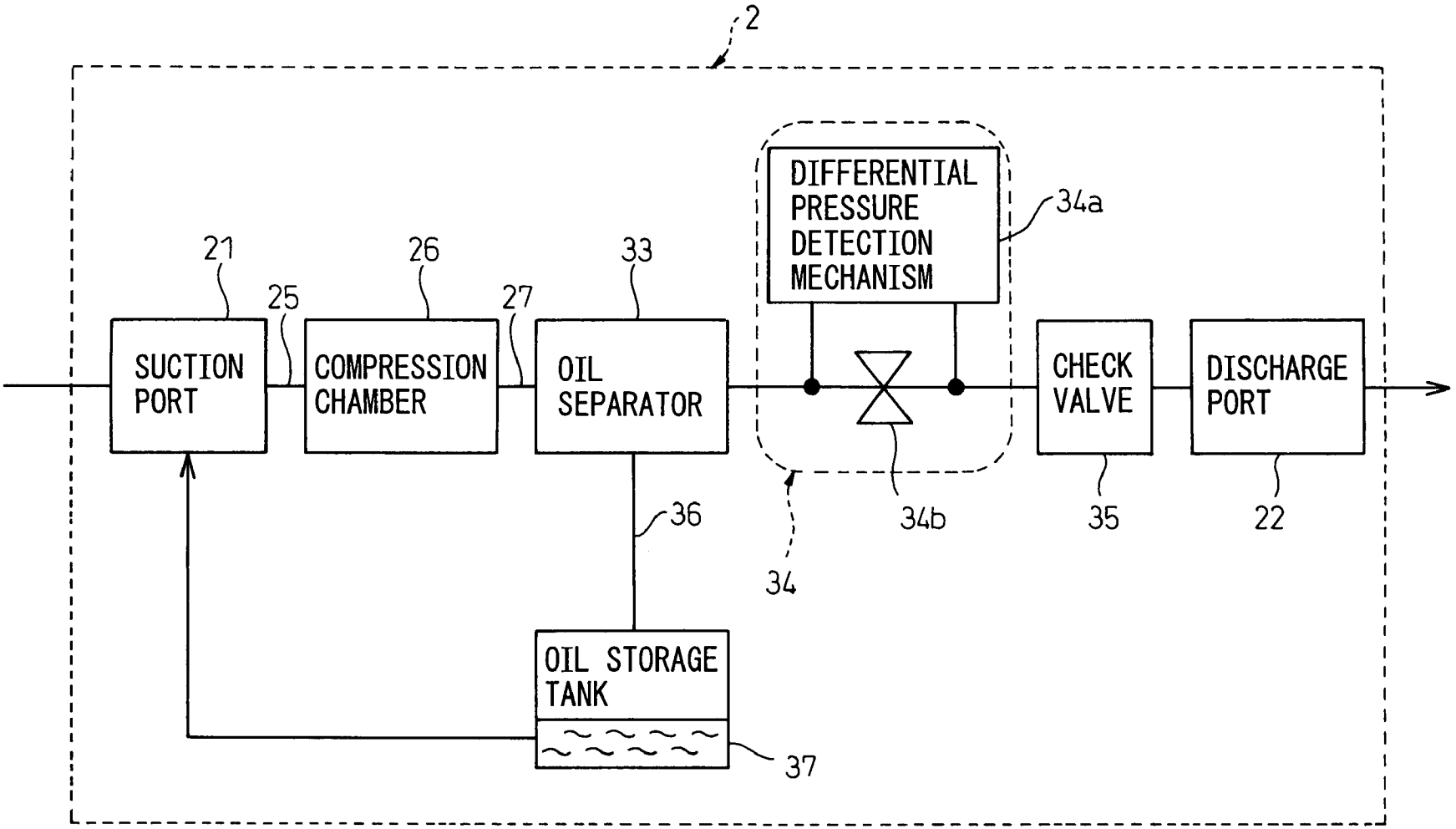
FIG. 2 is a view of the general constitution of a compressor according to an embodiment of the present invention.

Next, the general configuration of the compressor 2 used in the present embodiment will be explained based on FIG. 2. FIG. 2 is a view showing the general configuration of the compressor 2 of the present embodiment.

The compressor 2 is provided with a housing (not shown) having a suction port 21 for sucking refrigerant at the downstream side of the evaporator 6 and a discharge port 22 discharging a refrigerant compressed by a later explained compression chamber 26.

Inside the housing, a suction passage 25 connecting the suction port 21 and the compression chamber 26 and a discharge passage 22 connecting the compression chamber 26 and discharge port 22 are provided. The refrigerant sucked in from the evaporator 6 passes through the suction passage 25 and flows into the compression chamber 26, while the refrigerant compressed by the compression chamber 26 passes through the discharge passage 27 and flows out to the condenser 3. Note that the discharge passage 27 of the present embodiment corresponds to the discharge pressure region of the present invention.

The discharge passage 27 between the compression chamber 26 and the discharge port 22 is provided with, in order from the compression chamber 26 side, an oil separator 33, flow rate sensor 34, and check valve 35.

The oil separator 33 is for separating the lubrication oil from the refrigerant discharged from the compression chamber 26. The lubrication oil separated from the oil separator 33 is supplied through the oil circulation path 36 to the suction port 21.

The oil circulation path 36 is provided with an oil storage tank 37 storing lubrication oil separated by the oil separator 33. The lubrication oil in the oil storage tank 37 is supplied to the suction port 21 utilizing the differential pressure between the suction port 21 and the oil storage tank 37. Therefore, the lubrication oil is circulated in the order of the suction port 21→compression chamber 26→oil separator 33→oil storage tank 37→suction port 21.

At the downstream side of the oil separator 33, a flow rate sensor 34 is provided. In general, the larger the compressor 2 in discharge capacity and the greater the flow rate of the refrigerant flowing through the refrigeration cycle 1, the greater the pressure loss in the refrigeration cycle 1. That is, the pressure loss (differential pressure) between any two points in the refrigeration cycle 1 shows a positive correlation with the flow rate of the refrigerant in the refrigeration cycle 1. The flow rate sensor 34 in the present embodiment corresponds to the flow rate detecting means of the present invention.

For this reason, by obtaining a grasp of the differential pressure $\Delta P(t)=PsH-PsL$ between the two pressure monitoring points P1, P2, it is possible to indirectly detect the discharge capacity of the compressor 2. Therefore, the flow rate sensor 34 in the present embodiment detects the pressure loss (differential pressure) between two points by the later explained differential pressure detector 34*a* to thereby indirectly detect the flow rate of the refrigerant at the refrigeration cycle 1. Note that a throttle 34*b* is provided between two pressure monitoring points P1, P2 for generating a differential pressure $\Delta P(t)$.

Specifically, a differential pressure detector 34*a* is provided between the oil separator 33 in the discharge passage 27 connecting the compression chamber 26 and the discharge port 22 and the check valve 35. The differential pressure detector 34*a* is comprised of a first pressure sensor (not shown) detecting the pressure of a pressure monitoring point P1, a second pressure sensor (not shown) detecting the pressure of a pressure monitoring point P2, and a signal processing circuit (not shown) and functions as an electrical differential pressure detecting means. The discharge passage 27 is set with two pressure monitoring points P1, P2 separated by exactly a predetermined distance in the direction of flow of the refrigerant. A first pressure sensor detects a gas pressure PsH at the upstream side pressure monitoring point P1, while a second pressure sensor detects a gas pressure PsL at the downstream side pressure monitoring point P2. The signal processing circuit generates a new signal relating to the differential pressure ΔP(t) between the PsH and PsL based on the detection signals of the gas pressures PsH, PsL input from the two sensors and outputs it to the control device 100.

The check valve 35 is configured to open up the valve opening degree when the difference between the pressure at the flow rate sensor 34 side (check valve 35 upstream side pressure) and the pressure at the discharge port 22 side (check valve 35 downstream side pressure) before and after the check valve 35 at the discharge passage 27 exceeds a predetermined pressure difference. The check valve 35 functions as a backflow prevention mechanism sending a refrigerant toward the discharge port 22. That is, when the pressure at the flow rate sensor 34 side is sufficiently high due to operation of the compressor 2, the check valve 35 is opened and the circulation of the refrigerant of the refrigeration cycle 1 is maintained. On the other hand, when the compressor discharge capacity is minimized and otherwise the pressure at the discharge port 22 side is low, the check valve 35 is closed and the circulation of the refrigerant of the refrigeration cycle 1 is blocked.

Next, in the present embodiment, the control processing executed by the electrical control part 100 will be explained based on the flow chart of FIG. 3 to 4. This control routine is started in response to an operation signal from the air-conditioner operation switch SW in the state with the ignition switch of the vehicle engine 11 turned on and power supplied to the electrical control part 100 from a battery B (not shown).

Figure 3:
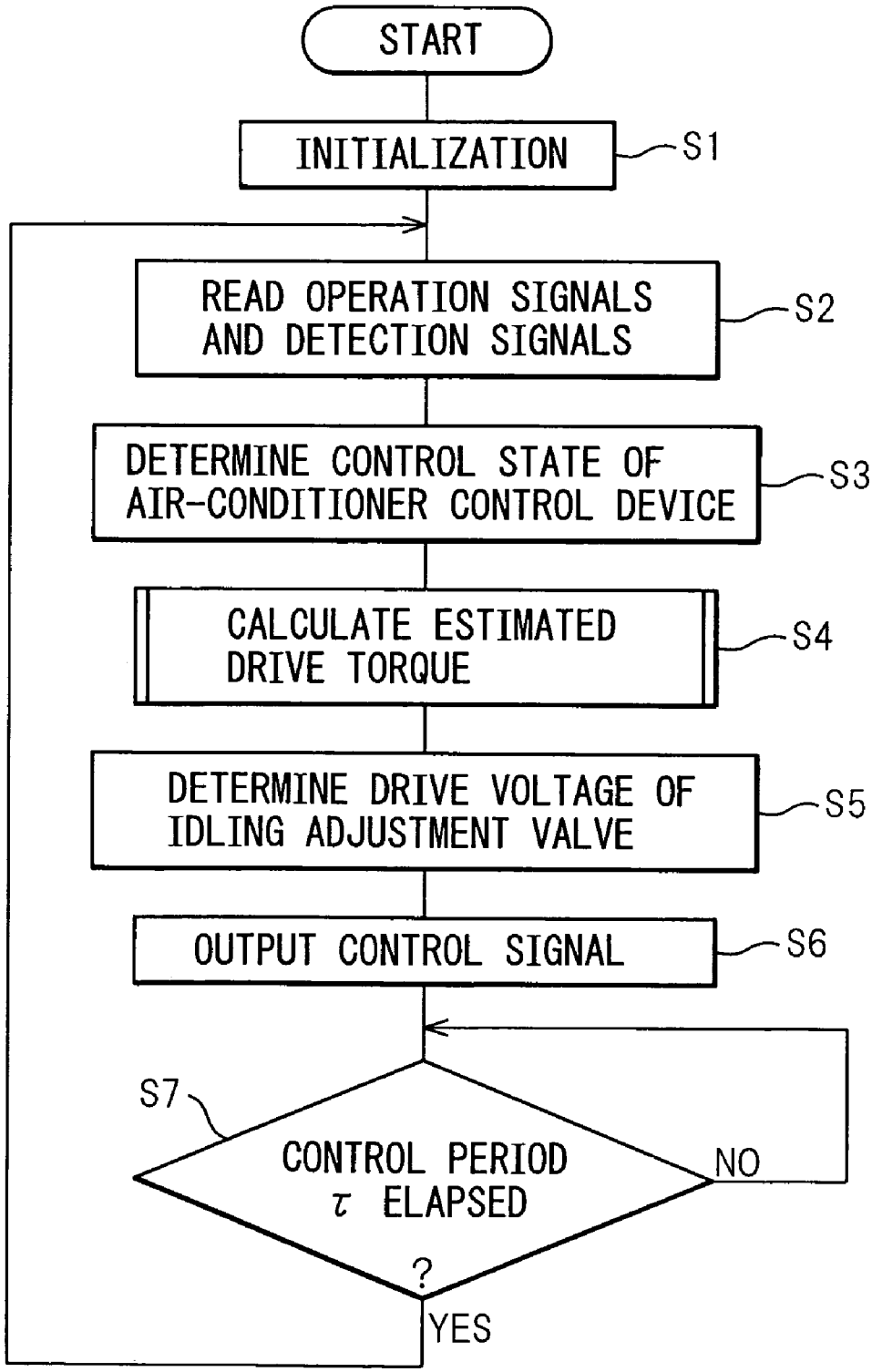
FIG. 3 is a flow chart showing control of an idling speed control device according to an embodiment of the present invention.
Figure 4:
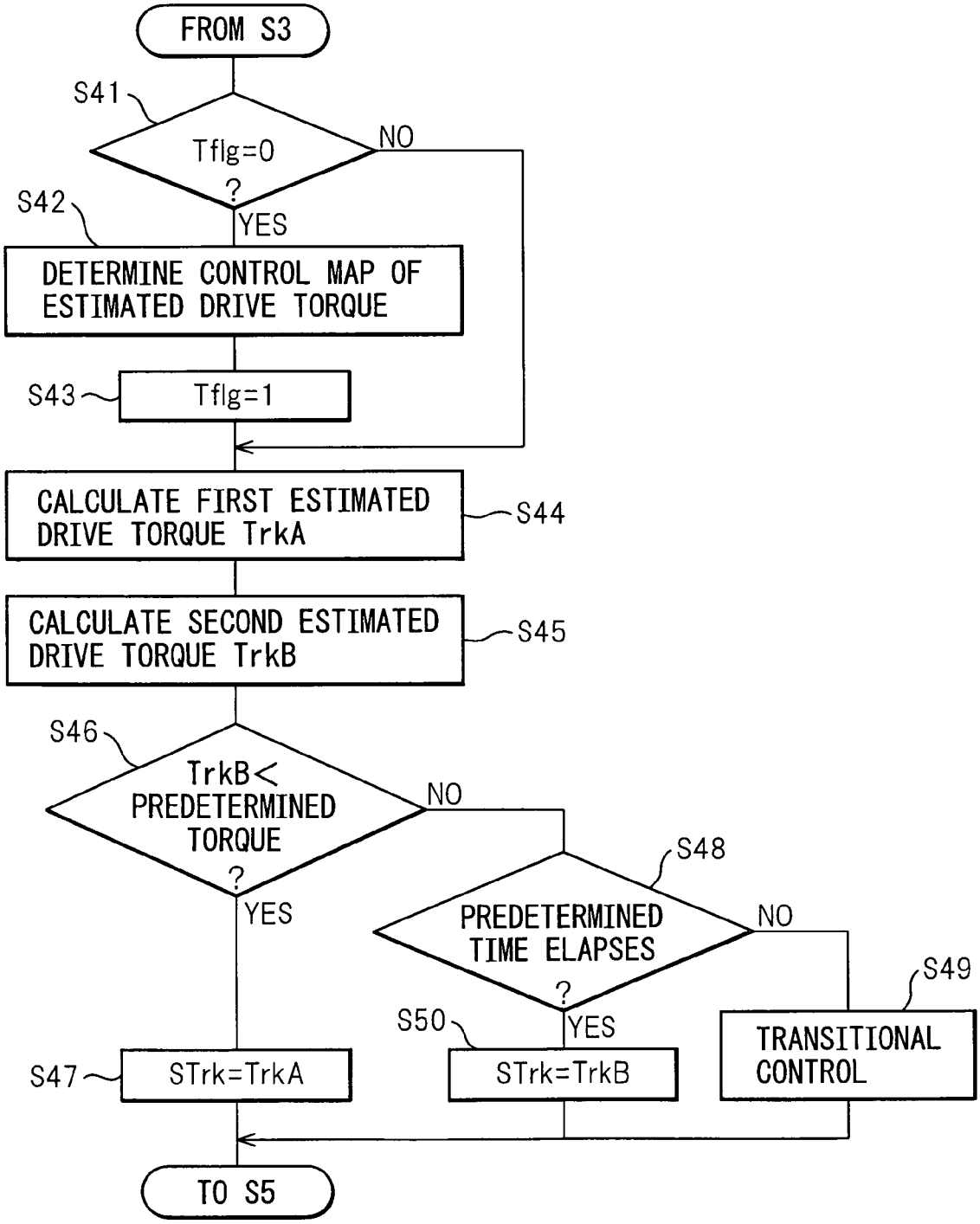
FIG. 4 is a flow chart showing principal parts of an idling speed control device according to an embodiment of the present invention.

First, at step S1 of FIG. 3, the flag, timer, etc. are initialized. As the flag, there is the startup judgment flag Tflg showing if the time is right after startup of the later explained compressor 2 etc. At step S1, Tflg becomes 0. The timer is built into the electrical control part 100. In the present embodiment, the compressor 2 becomes the elapsed time counting means for counting the elapsed time T from the time of start of compression.

Next, at step S2, the operation signals of the air-conditioner operation switches SW and the detection signals of the group of air-conditioning sensors 121 to 125 and the group of engine sensors 127, 128 are read.

Next, at step S3, the control states of the various types of actuators for control of the air-conditioning (air-conditioning control devices) 9, 12, etc. are determined. Specifically, the powered state is determined as the control signal to the electromagnetic clutch 9. Further, the target discharge temperature TAO is calculated and this TAO used to determine the control voltage Vfan supplied to an electric motor of the blower fan 12.

Note that the target discharge temperature TAO is calculated by the following formula F1 based on the fluctuation of the air conditioning heat load, cabin temperature (inside air temperature) Tr, and set temperature Tset set by the temperature setting switch of the air-conditioner operation switches SW:

$$TAO=K\text{set}\times T\text{set}-Kr\times Tr-Kam\times Tam-Ks\times Ts+C. \quad \text{(F1)}$$

where,

Tr: inside air temperature detected by inside air sensor 122,

Tam: outside air temperature detected by outside air sensor 121,

Ts: amount of sunlight detected by sunlight sensor 123,

Kset, Kr, Kam, Ks: control gains, and

C: correction constant.

Next, at step S4, the estimated drive torque STrk of the compressor 2 is estimated. Details of step S4 will be explained using the flow chart of FIG. 4. First, at step S41, it is judged if the time is right after startup of the compressor 2. Specifically, if the startup judgment flag Tflg is 0, it is judged that the time is right after startup and the routine proceeds to step S42. If Tflg is not 0, it is judged that the time is not right after startup and the routine proceeds to step S44.

At step S42, an increase degree ΔTrk for changing the first estimated drive torque TrkA along with an increase of the elapsed time T is determined based on the discharge side detection value read at step S2, that is, the discharge refrigerant pressure Pd, and the suction side pressure detection value, that is, the evaporator discharge air temperature Te. Specifically, it is determined with reference to the control map stored in advance in the microcomputer 100 based on the high/low pressure ratio Pd/Ps.

Note that, in the present embodiment, the increase degree ΔTrk is mapped to become smaller along with an increase of the high/low pressure ratio Pd/Ps. Therefore, by step S42, a control map for the first estimated drive torque having the elapsed time T as a variable is determined.

Next, at step S43, Tflg is made "1" and the routine proceeds to step S44. Next, at step S44, a first estimated drive torque TrkA is calculated based on the control map for the first estimated drive torque.

Next, at step S45, the second estimated drive torque TrkB is calculated based on the discharge side detection value read at step S2, that is, the discharge refrigerant pressure Pd, the suction side pressure detection value, that is, the evaporator discharge air temperature Te, the refrigerant flow rate Qd detected by the flow rate sensor 34, and the engine speed Ne detected by the engine speed sensor. Specifically, TrkB is calculated by the following formulas F2 and F3:

$$L=[(n/n-1)\times Pd\times Qd\times\{1-(Pd/Ps)^{(1-n/n)}\}]/\eta ad \quad \text{(F2)}$$

$$TrkB=(60/2\pi Nc)\times L \quad \text{(F3)}$$

Formula F2 is a formula generally used for calculating the power consumption L of the compressor 2, where n is the adiabatic exponent, Ps is a representative value of the low pressure side pressure in the case where the refrigeration cycle 1 is normally operating, and Qd is the refrigerant flow rate in the gas phase state of the compressor discharge side. Further, Nc is the compressor speed, while ηad is the compression efficiency of the compressor 2. Here, Nc can be calculated by multiplying the engine speed Ne read at step S2 with the pulley ratio.

Therefore, at step S45, the consumed power L of the compressor is calculated by the formula F2 and the second estimated drive torque TrkB is calculated from the formula F3. In this way, the second estimated drive torque TrkB becomes a value determined by the change of the refrigerant flow rate Qd detected by the flow rate sensor 34 etc.

Therefore, in the present embodiment, steps S41 to 44 become the first estimated drive torque calculating means for calculating the first estimated drive torque TrkA of the compressor 2 based on the discharge side detection value Pd and suction side detection value Ps, while step S45 becomes the second estimated drive torque calculating means for calculating the second estimated drive torque TrkB of the compressor 2 based on the refrigerant flow rate detected by the flow rate sensor 34.

Next, at step S46, if TrkB<predetermined torque, the routine proceeds to step S47 where the estimated drive torque STrk is made TrkA. If TrkB<predetermined torque, the routine proceeds to step S48. Here, the predetermined torque is a torque corresponding to the valve opening pressure of the check valve 35 provided at the discharge side of the compressor 2 and is found from the actually measured value of the refrigerant flow rate detected at the flow rate sensor 34. Note that the predetermined torque is stored in advance in the ROM etc. of the electrical control part 100.

At step S48, it is judged if it is right after the second estimated drive torque TrkB becomes a predetermined torque or more. Specifically, it is judged if the elapsed time from when the second estimated drive torque TrkB becomes a predetermined torque or more passes a predetermined time. When the predetermined time has not elapsed, the routine proceeds to step S49, while the predetermined time has elapsed, the routine proceeds to step S50.

At step S49, if suddenly switching from the first estimated drive torque TrkA to the second estimated drive torque TrkB, the estimated drive torque STrk will rapidly fluctuate, so transitional control is performed. The transitional control performs control to slowly change from the first estimated drive torque TrkA to approach the second estimated drive torque TrkB within a predetermined time.

On the other hand, at step S50, after the end of the transitional control of step S49, the estimated drive torque STrk is made TrkB. At step S46 to step S50, the estimated drive torque STrk is determined and the routine proceeds to step S5 of FIG. 2.

Therefore, in the present embodiment, for the switching from the first estimated drive torque TrkA to the second estimated drive torque TrkB at step S46 to S50, the first estimated drive torque TrkA is switched to the second estimated drive torque TrkB at the time when the check valve 35 is opened, that is, at the time the startup of the compressor is actually completed.

As explained above, in the present embodiment, the first estimated drive torque TrkA is switched to the second estimated drive torque TrkB at the time when the check valve 35 provided at the discharge side of the compressor 2 is opened, so there is no deterioration of the estimation precision of the actual compressor drive torque due to the delay of the switching timing. Further, the second estimated drive torque TrkB is calculated based on an actually measured value, that is, the flow rate of the refrigerant detected by the flow rate sensor 34, so it is possible to improve the precision of the estimated drive torque STrk.

That is, in the present embodiment, even in the transitional state right after the start of compression by the compressor 2, the idling speed is controlled based on the high precision estimated drive torque STrk suppressed in discrepancy from the actual drive torque, so the stability of the idling speed can be greatly improved.

Other Embodiments

In the above embodiment, as the control map of the first estimated drive torque, the control map of the estimated drive torque based on the discharge refrigerant pressure Pd and the suction refrigerant pressure Ps was used, but the invention is not limited to this. For example, it is also possible to use a control map of the estimated drive torque STrk per unit time or a control map of the estimated drive torque based on the drive power of the compressor 2. Note that in the above embodiment, the compressor drive torque behavior is greatly affected by the discharge refrigerant pressure Pd, so it is also possible to use a control map based on only the discharge refrigerant pressure Pd, a control map based on the pressure difference of the discharge refrigerant pressure Pd and suction refrigerant pressure Ps, etc.

Further, in the above embodiment, the predetermined torque used for the judgment of when to switch from the first estimated drive torque TrkA to the second estimated drive torque TrkB is stored in advance in the ROM of the electrical control part 100 etc., but the invention is not limited to this. The check valve 35 becomes higher in valve opening pressure when the pressure at the discharge port 22 side (pressure of downstream side of check valve 35) is a high pressure, so it is also possible to increase the predetermined torque in accordance with the pressure at the discharge port 22 side.

Further, in the above embodiment, the predetermined torque used for the judgment of when to switch from the first estimated drive torque TrkA to the second estimated drive torque TrkB is calculated from the actually measured value of the refrigerant flow rate detected from the flow rate sensor 34, but the invention is not limited to this. For example, rather than a predetermined torque, it is also possible to use whether the refrigerant flow rate detected by the flow rate sensor 34 exceeds a predetermined flow rate for this judgment. Furthermore, it is also possible to directly detect the opening degree of the check valve 35 and use whether the check valve 35 is actually open for the judgment.

Further, in the above embodiment, the suction side pressure detection value was calculated based on the evaporator discharge air temperature Te. The suction side pressure detection value is not limited to this. For example, it is also possible to calculate the suction side pressure detection value based on the temperature of the heat exchange fins of the evaporator 6. Further, as the suction side pressure detecting means, the low pressure side pressure sensor detecting the suction refrigerant pressure Ps of the compressor 2 is employed. The suction refrigerant pressure Ps detected by the low pressure side pressure sensor may also be employed as the suction side pressure detection value. Further, the suction refrigerant pressure Ps may be the detected value of the low pressure side refrigerant pressure in the refrigerant passage from the outlet side of the expansion valve 7 to the suction side of the compressor 2.

The present invention is not limited in application to an idling speed control device. So long as matching with the gist of the invention as described in the claims, it is not limited to the above embodiments and can be applied to various applications.

For example, it can also be applied to a heater or cooler having a compressor 2 driven by a stationary type engine. Further, the invention can also be applied to the case of controlling the amount of electric power supplied to a motor based on the estimated drive torque STrk so as to make the speed of the electric motor constant in a system having a variable capacity compressor 2 having an electric motor as a drive source.

While the invention has been described with reference to specific embodiments chosen for purpose of illustration, it should be apparent that numerous modifications could be made thereto by those skilled in the art without departing from the basic concept and scope of the invention.

The invention claimed is:

1. A compressor drive torque estimating device able to be utilized for a system provided with a refrigeration cycle in which a refrigerant is circulated by a compressor driven by a drive source carried in a vehicle, said compressor drive torque estimating device provided with:

a flow rate detecting means for detecting a flow rate of a refrigerant circulated through said refrigeration cycle, a check valve provided at a discharge pressure region of said compressor and opening only in a refrigerant discharge direction of said compressor, a storage part storing an estimated drive torque characteristic setting a correlation between a drive torque behavior of said compressor and an elapsed time from the start of operation of said compressor, a first estimated drive torque calculating means for calculating a first estimated drive torque of said compressor based on said estimated torque characteristic stored in said storage part, a second estimated drive torque calculating means for calculating a second estimated drive torque of said compressor based on a flow rate of the refrigerant detected by said flow rate detecting means, and an estimated drive torque switching means for switching an estimated drive torque of said compressor from said first estimated drive torque to said second estimated drive torque, wherein said estimated drive torque switching means switches said estimated drive torque of said compressor from said first estimated drive torque to said second estimated drive torque, based on a physical quantity corresponding to a valve opening pressure of said check valve.

2. A compressor drive torque estimating device as set forth in claim 1, wherein said estimated drive torque switching means switches the estimated drive torque of said compressor from said first estimated drive torque to said second estimated drive torque, based on an event that said second estimated drive torque becomes larger than a predetermined torque corresponding to a valve opening pressure of said check valve.

3. A compressor drive torque estimating device as set forth in claim 2, wherein said predetermined torque is increased in accordance with an increase of a pressure of the compressor discharge side.

4. A compressor drive torque estimating device for estimating a drive torque of a compressor of a refrigeration circuit in which a refrigerant is circulated by the compressor, wherein the compressor is driven by a drive source of a vehicle, the compressor drive torque estimating device comprising:

a flow rate detector for detecting a flow rate of a refrigerant circulated through the refrigeration circuit;

a check valve provided at a discharge pressure region of the compressor, wherein the check valve opens only to permit flow in a refrigerant discharge direction of the compressor; and a controller for determining a drive torque of the compressor, wherein the controller calculates a first estimated drive torque of the compressor based on stored estimated drive torque characteristics, which reflect a relationship between a drive torque behavior of the compressor and an elapsed time from the start of operation of the compressor;

calculates a second estimated drive torque of the compressor based on a flow rate of the refrigerant detected by the flow rate detector, and switches an estimated drive torque of the compressor from the first estimated drive torque to the second estimated drive torque, wherein the controller switches from the first estimated drive torque to the second estimated drive torque based on a physical quantity corresponding to a valve opening pressure of the check valve.

5. A compressor drive torque estimating device as set forth in claim 4, wherein the controller switches the estimated drive torque of the compressor from the first estimated drive torque to the second estimated drive torque based on an event that the second estimated drive torque becomes larger than a predetermined torque that corresponds to a valve opening pressure of the check valve.

6. A compressor drive torque estimating device as set forth in claim 5, wherein the predetermined torque is increased in accordance with an increase of a pressure of a discharge side of the compressor.

* * * * *